US005344288A

United States Patent [19]

Oda

[11] Patent Number: 5,344,288

[45] Date of Patent: Sep. 6, 1994

[54] DEVICE FOR CONTROLLING DISPLACEMENT OF VARIABLE DISPLACEMENT HYDRAULIC PUMP

[75] Inventor: Yosuke Oda, Kanagawa, Japan

[73] Assignee: Kabushiki Kaisha Komatsu Seisakusho, Tokyo, Japan

[21] Appl. No.: 10,392

[22] Filed: Jan. 28, 1993

[51] Int. Cl.[5] ..... F04B 49/08

[52] U.S. Cl. ..... 417/218; 417/222.1

[58] Field of Search ..... 417/218, 222.1

[56] References Cited

U.S. PATENT DOCUMENTS

| | | | |
|---|---|---|---|
| 4,710,106 | 12/1987 | Iwata et al. | 417/218 |
| 5,173,031 | 12/1992 | Nonnemacher | 417/218 |
| 5,190,445 | 3/1993 | Ikari | 417/218 |

FOREIGN PATENT DOCUMENTS

| | | | |
|---|---|---|---|
| 3129490 | 2/1983 | Fed. Rep. of Germany | 417/218 |
| 52-20403 | 2/1977 | Japan . | |
| 131891 | 8/1982 | Japan | 417/218 |
| 4-137285 | 12/1992 | Japan . | |
| 1025913 | 6/1983 | U.S.S.R. | 417/222.1 |

*Primary Examiner*—Richard A. Bertsch

*Assistant Examiner*—Peter Korytnyk

*Attorney, Agent, or Firm*—Cushman, Darby & Cushman

[57] ABSTRACT

A displacement control device of a variable-displacement hydraulic pump which increases the response speed when the pump discharge pressure is low and suppresses increase of the response speed when the pump discharge pressure is high. The displacement control device has a variable-displacement piston 3 which activates a displacement control member 2 of the variable displacement hydraulic pump 1, a circuit 10 which provides a communication between a large-diameter pressure chamber 6 on the variable-displacement piston 3 and an output port 9 of the control valve 7, and a variable restriction valve 11 which is provided in the circuit 10. The restriction valve 11 increases and decreases its opening area when the pump discharge pressure is low and high, respectively. When the pump discharge pressure is low, the pump discharge pressure is smoothly introduced into the large-diameter pressure chamber 6 through the control valve 7, whereas, when the pump discharge pressure is high, the supply of the discharge pressure to the large-diameter pressure chamber is restricted.

9 Claims, 2 Drawing Sheets

DEVICE FOR CONTROLLING DISPLACEMENT OF VARIABLE DISPLACEMENT HYDRAULIC PUMP

BACKGROUND OF THE INVENTION

1. Field of the Invention

The present invention relates to a device for controlling the displacement of a variable-displacement hydraulic pump by using the delivery pressure of the pump.

2. Description of Related Art

Various devices are known for controlling the displacement of a variable- displacement hydraulic pump, i.e., the amount of fluid discharged per revolution of the pump shaft.

An apparatus such as is shown in FIG. 1 (PRIOR ART) controls displacement by using a discharge pressure of the pump. More specifically, a variable-displacement pump 1 has a displacement control member 2 which is connected to a variable-displacement piston 3. A pressure chamber 4 defined on the small-diameter end of the piston 3 communicates with a discharge passage 5 of the variable-displacement pump 1, while a pressure chamber 6 defined at a large-diameter end of the piston 3 communicates with the discharge passage 5 through a control valve 7. The control valve 7 is urged by the pressure in the discharge passage 5, i.e., the discharge pressure P1 of the pump, towards a communicating position A. At the same time, the control valve 7 is urged towards a drain position B by a pressure acting on the outlet side of an operation valve 8, i.e., by the load pressure P2. When there is a large difference between the discharge pressure P1 and the load pressure P2, the control valve 7 is urged to and held in the communicating position so that the discharge pressure is supplied to the large-diameter pressure chamber 6, whereby the variable displacement piston 3 is actuated towards the small-displacement side due to the difference in the area between the pressure chambers. Conversely, when the above-mentioned difference in the pressure between P1 and P2 is small, the control valve 7 is held in the drain position B so as to reduce the pressure in the large-diameter pressure chamber 6, whereby the variable-displacement piston 3 is urged towards the large-diameter side.

This known displacement control device, however, suffers from the problem that the velocity of movement of the variable-displacement piston 3, i.e., the response speed, varies depending on the rate of change in the pressure inside the large-diameter pressure chamber 6 on the variable-displacement pump 3. Consequently, the response speed is high or low, when the discharge pressure P1 is high or low, respectively. Therefore, if the pump is adjusted to obtain a sufficiently higher response speed when the discharge pressure P1 is low, the response speed is excessively increased when the discharge pressure P1 is high. Consequently, various problems arise such as damage to internal parts such as a swash plate due to collision with a stopper, or occurrence of cavitation due to a drastic reduction in the suction pressure caused by a rapid increase in the displacement.

SUMMARY OF THE INVENTION

In view of the above-described problems, an object of the present invention is to provide a displacement control device for controlling the displacement of a variable-displacement pump by using the discharge pressure of the pump.

According to the present invention, a variable restriction valve is provided in a circuit connected to the pressure chambers on the variable-displacement piston, the variable-restriction valve increases its opening area when the discharge pressure is low and decreases the opening area when the discharge pressure is high. Therefore, the discharge pressure is smoothly introduced into the pressure chamber on the piston even when the discharge pressure of the variable-displacement pump is low, by virtue of the increased opening area of the variable-restriction valve. On the other hand, when the discharge pressure is high, the opening area of the variable-restriction valve is decreased so that the introduction of the discharge pressure into the pressure chamber is retarded, thereby preventing the response speed from becoming excessively high, while avoiding occurrence of cavitation.

Further objects, features and advantages of the present invention will become apparent from the Description of the Preferred Embodiment which follows, when considered together with the attached drawings.

DESCRIPTION OF THE PREFERRED EMBODIMENT

Figure 1:
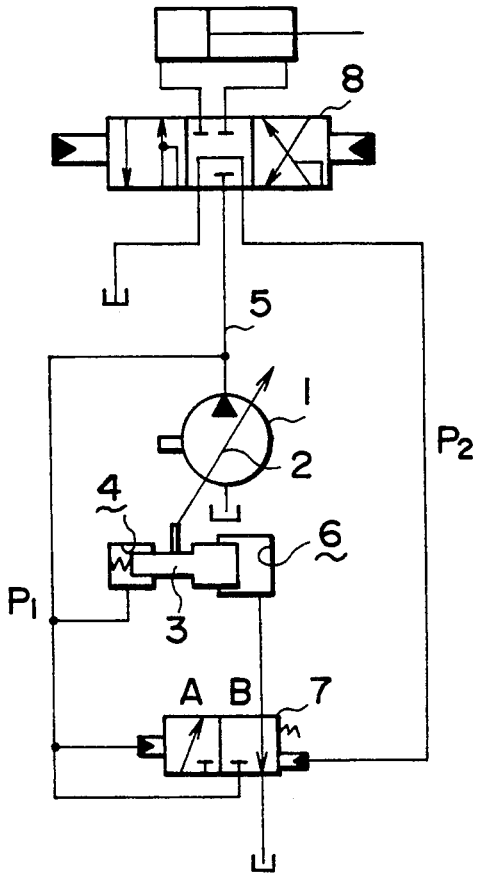
FIG. 1 (PRIOR ART)
FIG. 1 (PRIOR ART) is an illustration of a known variable-displacement hydraulic pump.
Figure 2:
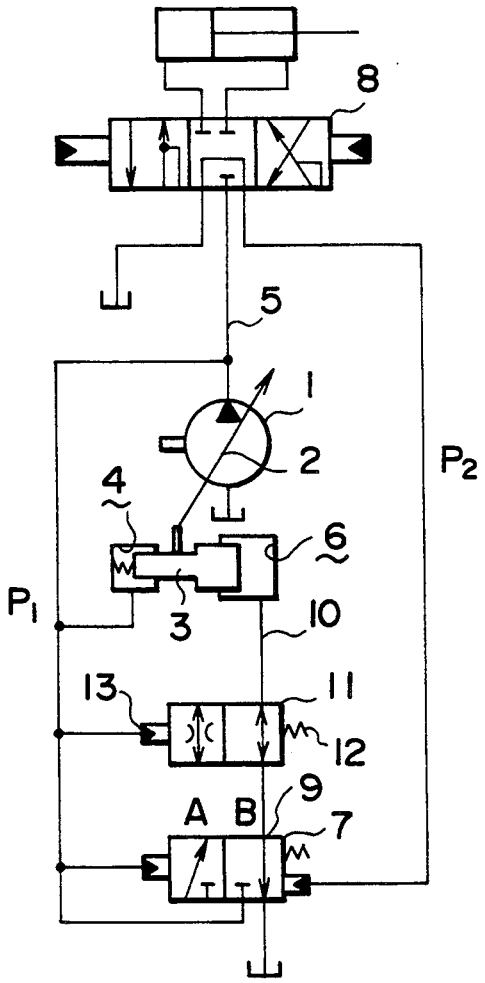
FIG. 2 is an illustration of a device according to the present invention for controlling the displacement of a variable-displacement hydraulic pump.
Figure 3:
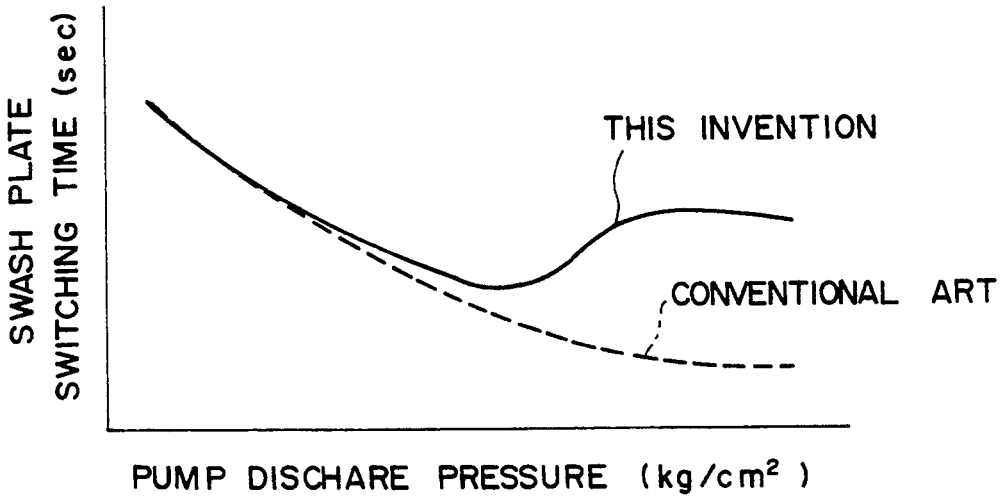
FIG. 3 is a diagram showing the relationship between the discharge pressure and a time required for switching of the switching plate when a variable restriction valve in accordance with the present invention is employed.

An embodiment of the present invention will be described with reference to FIGS. 2 and 3. In these Figures, members or parts which are the same as those in the known device of FIG. 1 are denoted by the same reference numerals.

Variable restriction valve 11 is provided in a circuit which provides communication between large-diameter pressure chamber 6 on variable-displacement piston 3 and output port 9 of control valve 7. Variable restriction valve 11 has, at its one end, pressure receiving portion 13 which receives discharge pressure P1. Spring 12 is loaded to act on an end of the variable restriction valve 11 opposite to pressure receiving portion 13 so as to urge variable restriction valve 11 in a direction so as to increase the opening area of valve 11. When discharge pressure P1 exceeds a predetermined set pressure, the force produced by this pressure overcomes the urging force of spring 12 so that variable restriction valve 11 is forced back to decrease the opening area.

A description will now be given of the operation of the device for controlling displacement of a variable displacement hydraulic pump according to the preferred embodiment of the present invention. When the discharge pressure P1 is below a set pressure, an opening area of variable restriction valve 11 is increased so that discharge pressure P1 is transmitted smoothly between control valve 7 and large-diameter pressure chamber 6 so as to enhance the response speed, whereas, when discharge pressure P1 exceeds the set pressure, the opening area of variable restriction valve 11 is decreased so that the transmission of discharge pressure P1 between control valve 7 and the large-diameter pressure chamber 6 is controlled to reduce the response speed. FIG. 3 is a chart showing the relationship between the level of the discharge pressure P1 and the time required for switching the swash plate. It will be seen that the time required for switching the swash plate is long when the discharge pressure P1 is high. It is thus possible to avoid excessively high response speed, thereby preventing problems such as damage of internal parts of the hydraulic pump or the occurrence of cavitation.

While the present invention has been described with reference to a preferred embodiment, one of ordinary skill in the art will recognize that further modifications, substitutions and improvements can be made while remaining within the spirit and scope of the invention. The scope of the invention is determined solely by the appended claims.

What is claimed is:

1. In a displacement control device for a variable-displacement hydraulic pump having a displacement control member for controlling a discharge pressure of said pump, and a variable displacement piston for activating the displacement control member when pressure is supplied to a first pressure chamber, said pressure chamber being supplied with discharge pressure over a circuit, the improvement comprising:

a variable restriction valve disposed in said circuit having an opening area controlling flow through the variable restriction valve, and means for decreasing the opening area when the discharge pressure exceeds a predetermined pressure, including a pressure receiving portion for receiving discharge pressure from said circuit and urging the valve in a first direction to decrease said opening area, and a biasing member biasing the variable restriction valve in a second direction to increase said opening area.

2. A device for controlling the displacement of a variable displacement pump, wherein the pump comprises a displacement control member and produces a discharge pressure through a discharge passage connected to an operation valve, wherein said operation valve produces a load pressure in a load line, said device for controlling comprising:

a variable displacement piston having a first end and a second end, the piston being operably connected to the displacement control member of the pump;

a first pressure chamber defined on the first end of the variable displacement piston and connected to the discharge line;

a second pressure chamber defined on the second end of the variable displacement piston;

a control valve connected to the second pressure chamber, the discharge line and the load line, constructed to be in a first position when the difference between the discharge pressure and the load pressure exceeds a first predetermined value and a second position when the difference between the discharge pressure and the load pressure does not exceed the first predetermined value, wherein in the first position the second pressure chamber is made to communicate with the discharge line, and in the second position the second pressure chamber discharges; and a variable restriction valve disposed in a control line connecting the second pressure chamber and the control valve.

3. A device according to claim 2, wherein the first end of the variable displacement piston has a smaller diameter than the second end of the variable displacement piston.

4. A device according to claim 3, wherein the variable restriction valve is connected to the discharge line and restricts flow in the control line by decreasing an opening in the variable restriction valve when the discharge pressure exceeds a second predetermined value.

5. A device according to claim 4, wherein the discharge pressure urges the variable restriction valve in a direction restricting the opening, and a spring bias urges the valve in another direction opening the opening.

6. A device according to claim 5, wherein the spring bias determines the second predetermined value.

7. A device according to claim 2, wherein the variable restriction valve is connected to the discharge line and restricts flow in the control line by decreasing an opening in the variable restriction valve when the discharge pressure exceeds a second predetermined value.

8. A device according to claim 7, wherein the discharge pressure urges the variable restriction valve in a direction restricting the opening, and a spring bias urges the valve in another direction opening the opening.

9. A device according to claim 8, wherein the spring bias determines the second predetermined value.

* * * * *